US011415151B2

(12) United States Patent
Sun

(10) Patent No.: US 11,415,151 B2
(45) Date of Patent: Aug. 16, 2022

(54) VACUUM PUMP, AND CONTROL DEVICE OF VACUUM PUMP

(71) Applicant: Edwards Japan Limited, Chiba (JP)

(72) Inventor: Yanbin Sun, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 16/967,889

(22) PCT Filed: Feb. 8, 2019

(86) PCT No.: PCT/JP2019/004744
§ 371 (c)(1),
(2) Date: Aug. 6, 2020

(87) PCT Pub. No.: WO2019/159854
PCT Pub. Date: Aug. 22, 2019

(65) Prior Publication Data

US 2021/0025406 A1 Jan. 28, 2021

(30) Foreign Application Priority Data

Feb. 16, 2018 (JP) ..... JP2018-025853

(51) Int. Cl.
*H05K 7/20* (2006.01)
*F04D 29/58* (2006.01)
(Continued)

(52) U.S. Cl.
CPC ..... *F04D 29/5813* (2013.01); *F28D 9/0081* (2013.01); *F04D 19/042* (2013.01)

(58) Field of Classification Search
CPC ... F04D 29/5813; F04D 19/042; F28D 9/0081
(Continued)

(56) References Cited

U.S. PATENT DOCUMENTS 5,971,725 A * 10/1999 de Simon ..... F04D 19/04 417/423.1
6,755,611 B1 * 6/2004 Kabasawa ..... F04D 19/042 415/90
(Continued)

FOREIGN PATENT DOCUMENTS

DE 102007028475 A1 9/2008
EP 3754203 A1 * 12/2020 ..... F04B 39/00
(Continued)

OTHER PUBLICATIONS

PCT International Search Report dated May 21, 2019 for corresponding PCT Application No. PCT/JP2019/004744.
(Continued)

*Primary Examiner* — Anatoly Vortman
(74) *Attorney, Agent, or Firm* — Theodore M. Magee; Westman, Champlin & Koehler, P.A.

(57) ABSTRACT

To provide a vacuum pump capable of efficiently cooling electrical equipment. The vacuum pump includes a pump main body and an electrical equipment case disposed outside the pump main body, wherein the electrical equipment case includes a cooling jacket which has an inner surface and an outer surface in a vertical portion and in which a cooling medium flow passage is formed, and a plurality of electrical equipment that have circuit components and can be cooled by the cooling jacket. The inner surface and the outer surface are formed facing different directions, and the electrical equipment portions are attached respectively to the inner surface and the outer surface so that heat can be transferred.

4 Claims, 2 Drawing Sheets

(51) Int. Cl.
*F28D 9/00* (2006.01)
*F04D 19/04* (2006.01)

(58) Field of Classification Search
USPC ..... 361/689
See application file for complete search history.

(56) References Cited

U.S. PATENT DOCUMENTS

| | | | | |
|---|---|---|---|---|
| 7,106,595 | B2 * | 9/2006 | Foster, Sr. | G06F 1/185 165/80.3 |
| 7,393,228 | B2 * | 7/2008 | Kabasawa | H01R 13/631 439/247 |
| 7,572,096 | B2 * | 8/2009 | Nonaka | F04D 29/023 415/90 |
| 7,753,661 | B2 * | 7/2010 | Okudera | F04D 25/06 417/423.4 |
| 7,755,897 | B2 * | 7/2010 | Chen | H01L 23/427 361/707 |
| 7,957,134 | B2 * | 6/2011 | Farnsworth | H01L 23/427 361/679.54 |
| 7,993,113 | B2 * | 8/2011 | Namiki | F16F 15/085 417/363 |
| 8,366,380 | B2 * | 2/2013 | Sakaguchi | F04D 29/644 415/90 |
| 8,651,838 | B2 * | 2/2014 | Birkenstock | F04D 29/083 417/423.4 |
| 8,690,525 | B2 * | 4/2014 | Ohtachi | F04D 27/001 415/119 |
| 8,961,105 | B2 * | 2/2015 | Kogame | F04D 19/04 415/55.1 |
| 9,245,820 | B2 * | 1/2016 | Goldrian | H05K 7/2039 |
| 9,267,392 | B2 * | 2/2016 | Schroder | F04D 25/0693 |
| 9,534,506 | B2 * | 1/2017 | Okudera | F04D 19/042 |
| 9,964,112 | B2 * | 5/2018 | Yamato | F04D 29/58 |
| 10,001,126 | B2 * | 6/2018 | Miwata | F04D 29/584 |
| 10,233,943 | B2 * | 3/2019 | Moriyama | F04D 29/058 |
| 10,760,578 | B2 * | 9/2020 | Shiba | F04D 25/06 |
| 2005/0276021 | A1 * | 12/2005 | Gates | H01L 23/3672 361/709 |
| 2007/0201208 | A1 * | 8/2007 | Goodwin | G06F 1/20 361/701 |
| 2013/0189090 | A1 * | 7/2013 | Okudera | F04B 37/14 415/182.1 |
| 2016/0195098 | A1 * | 7/2016 | Omori | F04D 29/4206 417/423.7 |
| 2018/0254685 | A1 * | 9/2018 | Seki | F04C 15/0096 |
| 2019/0242386 | A1 * | 8/2019 | Shimizu | F04D 19/04 |
| 2019/0277296 | A1 * | 9/2019 | Okada | F04D 19/04 |
| 2021/0025407 | A1 * | 1/2021 | Sun | F04B 37/16 |

FOREIGN PATENT DOCUMENTS

| | | | |
|---|---|---|---|
| JP | S642397 | U | 1/1989 |
| JP | S645045 | U | 1/1989 |
| JP | H07194139 | A | 7/1995 |
| JP | 2008244062 | A | 10/2008 |
| JP | 2010079397 | A | 4/2010 |
| JP | 2013100760 | A | 5/2013 |
| JP | 2014043827 | A | 3/2014 |
| JP | 2015049443 | A | 3/2015 |
| JP | 2017153339 | A | 8/2017 |
| JP | 2017200314 | A | 11/2017 |
| WO | 2011111209 | A1 | 9/2011 |
| WO | 2012053271 | A1 | 4/2012 |
| WO | 2019159855 | A1 | 8/2019 |

OTHER PUBLICATIONS

PCT International Written Opinion dated May 21, 2019 for corresponding PCT Application No. PCT/JP2019/004744.
PCT International Search Report dated May 21, 2019 for corresponding PCT Application No. PCT/JP2019/004745.
PCT International Written Opinion dated May 21, 2019 for corresponding PCT Application No. PCT/JP2019/004745.
European Communication dated Oct. 11, 2021 and Search Report dated Oct. 1, 2021 for corresponding European application Serial No. 19753700.4, 8 pages.

* cited by examiner

VACUUM PUMP, AND CONTROL DEVICE OF VACUUM PUMP

CROSS-REFERENCE OF RELATED APPLICATION

This application is a Section 371 National Stage Application of International Application No. PCT/JP2019/004744, filed Feb. 8, 2019, which is incorporated by reference in its entirety and published as WO 2019/159854 A1 on Aug. 22, 2019 and which claims priority of Japanese Application No. 2018-0:25853, filed Feb. 16, 2019.

BACKGROUND

The present invention relates to a vacuum pump such as a turbomolecular pump, and a control device of the vacuum pump.

The turbomolecular pump device disclosed in, for example, WO 2011/111209, has conventionally been known. The turbomolecular pump device of WO 2011/111209 is provided with cooling devices 13 as described in paragraph 0010 and shown in FIGS. 1, 2, and the like. The cooling devices 13 are interposed side by side in the axial direction between a pump main body 11 and a power supply apparatus 14, and cool mainly electronic components of a motor drive circuit in the power supply apparatus 14. The cooling devices 13 each have a jacket main body 13a in which a cooling water passage is formed, and a cooling water inlet 13b and a cooling water outlet 13c for circulating cooling water in the cooling water passage by means of a water-feeding pump.

The discussion above is merely provided for general background information and is not intended to be used as an aid in determining the scope of the claimed subject matter. The claimed subject matter is not limited to implementations that solve any or all disadvantages noted in the background.

SUMMARY

Incidentally, vacuum pumps such as turbomolecular pumps need to be downsized for reasons such as the surrounding space of the vacuum equipment to be connected. In some cases, electrical equipment such as motor drive circuits and control circuits need to be downsized as well, and in such a case, the mounting density of the electrical equipment increases easily, thereby raising the temperatures of the electrical equipment. The mounting density of the electrical equipment is increased also by improved performance of the vacuum pump, thereby easily increasing the temperatures of the electrical equipment. For this reason, even when the cooling devices disclosed in, for example, WO 2011/111209 are used, cooling needs to be performed as efficient as possible. Efficient cooling can extend the life of the electrical equipment. Further, although the water-cooling type cooling device is suitable for cooling a limited area such as a part that is in contact with or faces the cooling device, it is difficult to cool an area larger than the outer shape of the cooling device.

In order to enhance the cooling effect, air cooling using, for example, a cooling fan in place of the water cooling described in WO 2011/111209 is considered. However, the external dimensions of the vacuum pump increase by providing the cooling fan, making downsizing of the vacuum pump difficult. Moreover, use of the cooling fan causes the generated air flow to raise dust in the clean room, making it difficult to maintain the clean environment. In addition, when the cooling fan is used, intensive use of an air conditioner to eliminate the raised dust may result in an increase of the total energy consumption. For these reasons, it is difficult to employ air cooling to achieve efficient cooling in a vacuum pump such as a turbomolecular pump; thus, it is desired that water cooling be employed.

The present invention was contrived in order to solve the foregoing problems, and an object thereof is to provide a vacuum pump capable of efficiently cooling electrical equipment, and a control device of the vacuum pump.

In order to achieve the object described above, the present invention provides a vacuum pump comprising a pump main body, and a control device disposed outside the pump main body, wherein the control device includes a cooling portion which has a cooling surface and in which a cooling medium flow passage is formed, and a plurality of electrical component portions that each have a heat generating component and is capable of being by the cooling portion, a plurality of the cooling surfaces are formed facing different directions, and the plurality of electrical component portions are attached to the plurality of cooling surfaces respectively so that heat can be transferred.

In order to achieve the object described above, the present invention according to another aspect is a vacuum pump, wherein the plurality of electrical component portions have a circuit board that has the heat generating components mounted thereon and is fixed to the cooling surface, and at least one of the plurality of electrical component portions is provided with a mold portion that covers the circuit board and the heat generating components at least partially.

In order to achieve the object described above, the present invention according to another aspect is a vacuum pump, wherein the control device is divided into a plurality of housing spaces by the cooling portion, and each of the housing spaces includes at least one of the plurality of electrical component portions.

In order to achieve the object described above, the present invention according to another aspect provides a control device of a vacuum pump, comprising a cooling portion which has a cooling surface and in which a cooling medium flow passage is formed; and a plurality of electrical component portions that each have a heat generating component and can be cooled by the cooling portion, wherein a plurality of the cooling surfaces are formed facing different directions, and the plurality of electrical component portions are attached to the plurality of cooling surfaces respectively so that heat can be transferred.

The present invention can provide a vacuum pump capable of efficiently cooling electrical equipment, and a control device of the vacuum pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
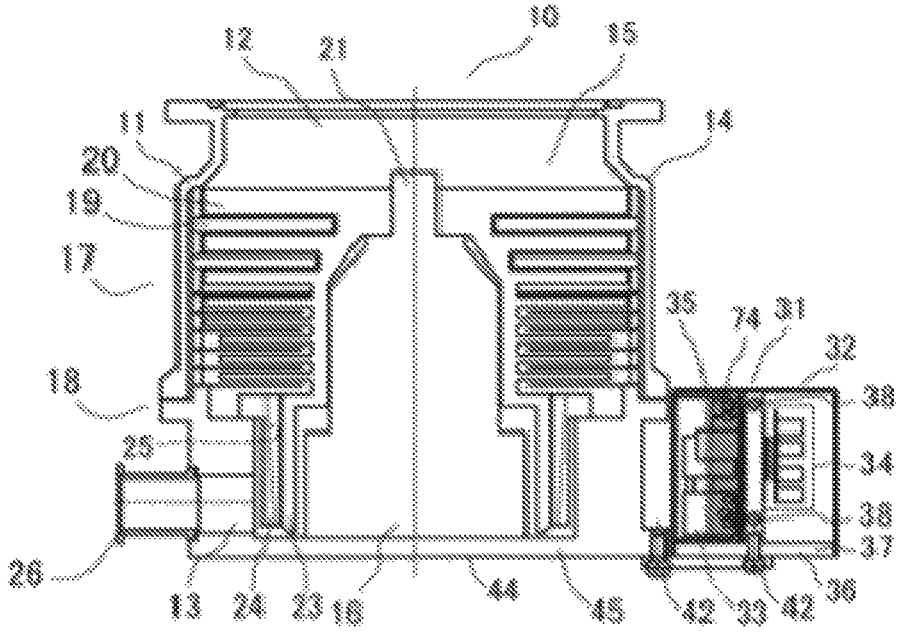
FIG. 1A is a cross-sectional view schematically showing a turbomolecular pump according to an embodiment of the present invention.
FIG. 1B is a cross-sectional view showing an enlargement of an electrical box.
Figure 1:
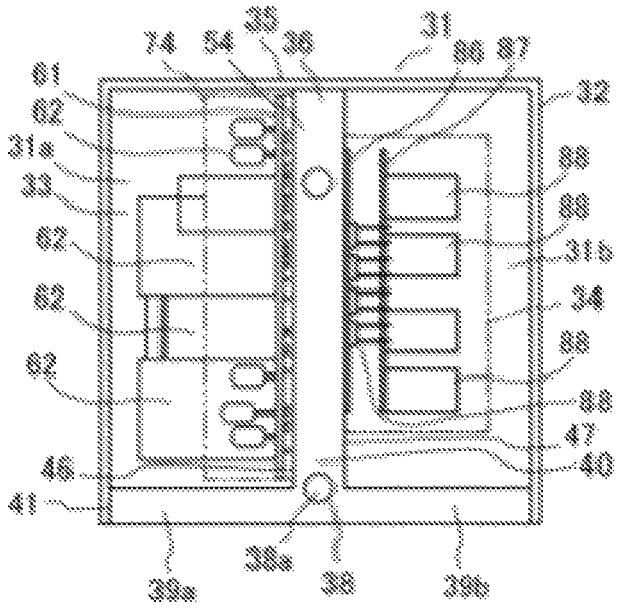

A vacuum pump according to one embodiment of the present invention is now described hereinafter with reference to the drawings. FIG. 1A schematically shows a vertical cross section of a turbomolecular pump 10 as the vacuum pump, wherein part of the vacuum pump is omitted. The turbomolecular pump 10 is connected to a vacuum chamber (not shown) of a target device such as a semiconductor manufacturing device, an electron microscope, or a mass spectrometer.

The turbomolecular pump 10 integrally has a cylindrical pump main body 11 and a box-shaped electrical equipment case 31 as an electrical equipment storage (control device). The pump main body 11 has an inlet portion 1:2 on the upper side in the drawing which is connected to a side of the target device, and an exhaust portion 13 on the lower side which is connected to an auxiliary pump or the like. The turbomolecular pump 10 can be used not only in a vertical posture in the vertical direction as shown in FIG. 1A, but also in an inverted posture, a horizontal posture, and an inclined posture.

The electrical equipment case 31 is attached to an outer peripheral surface, which is a side portion of the pump main body 11, in such a manner as to protrude in a radial direction. Thus, the turbomolecular pump 10 of the present embodiment is downsized in the axial direction as compared to the type disclosed in, for example, WO 2011/111209 in which the pump main body and the electrical equipment (electrical component) are arranged in the axial direction (gas transfer direction). Furthermore, the turbomolecular pump 10 of the present embodiment can be installed even if an axial space is relatively narrow.

The pump main body 11 has a cylindrical main body casing 14 with steps. In the present embodiment, the main body casing 14 has a diameter of approximately 350 mm and a height of approximately 400 mm. The inside of the main body casing 14 is provided with an exhaust mechanism portion 15 and a rotary drive portion 16. The exhaust mechanism portion 15 is of a composite type composed of a turbomolecular pump mechanism portion 17 and a thread groove pump mechanism portion 18.

The turbomolecular pump mechanism portion 17 and the thread groove pump mechanism portion 18 are disposed in a continuous fashion in the axial direction of the pump main body 11; in FIG. 1A, the turbomolecular pump mechanism portion 17 is disposed on the upper side in the drawing and the thread groove pump mechanism portion 18 is disposed on the lower side in the drawing. General structures can be employed as basic structures of the turbomolecular pump mechanism portion 1'7 and the thread groove pump mechanism portion 18; the basic structures are schematically described hereinafter.

The turbomolecular pump mechanism portion 17 disposed on the upper side in FIG. 1A transfers gas by means of a large number of turbine blades, and includes a stator blade portion 19 and a rotor blade portion 20 that each have a predetermined inclination or curved surface and are formed radially. In the turbomolecular pump mechanism portion 17, stator blades and rotor blades are arranged alternately in dozens of stages, but the illustration of reference numerals for the stator blades and the rotor blades are omitted in order to prevent the drawing from becoming complicated. In FIG. 1A, the illustration of hatching showing the cross sections of components in the pump main body 11 are omitted as well, in order to prevent the drawing from becoming complicated.

The stator blade portion 19 is provided integrally on the main body casing 14, and the rotor blades provided in the rotor blade portion 20 are each sandwiched between upper and lower stator blades provided in the stator blade portion 19. The rotor blade portion 20 is integrated with a rotating shaft (rotor shaft) 21, only an upper end of which is schematically shown in FIG. 1A.

The rotating shaft 21 passes through the thread groove pump mechanism portion 18 on the lower side and is coupled to the abovementioned rotary drive portion 16, only the outline of which is schematically shown in the drawing. The thread groove pump mechanism portion 18 includes a rotor cylindrical portion 23 and a thread stator 24, wherein a thread groove portion 25, which is a predetermined gap, is formed between the rotor cylindrical portion 23 and the thread stator 24. The rotor cylindrical portion 23 is coupled to the rotating shaft 21 so as to be able to rotate integrally with the rotating shaft 21. An outlet port 26 to be connected to an exhaust pipe is disposed below the thread groove pump mechanism portion 18, whereby the inside of the outlet port 26 and the thread groove portion 25 are spatially connected.

The rotary drive portion 16 is a motor and includes, although not shown, a rotor formed on an outer periphery of the rotating shaft 21 and a stator disposed so as to surround the rotor. The power for activating the rotary drive portion 16 is supplied by power supply equipment or control equipment stored in the electrical equipment case 31 described above.

Although not shown, a non-contact type bearing by magnetic levitation (magnetic bearing) is used to support the rotating shaft 21. Therefore, the pump main body 11 can realize an environment in which the pump is not worn when rotated at high speed, has a long life, and does not require lubricating oil. A combination of a radial magnetic bearing and a thrust hearing can be employed as the magnetic bearing. Further, the magnetic bearing can be used in combination with a touchdown bearing to prevent possible damage.

Driving the rotary drive portion 16 rotates the rotor blade portion 20 and the rotor cylindrical portion 23 of the turbomolecular pump mechanism portion 17 that are integrated with the rotating shaft 21. When the rotor blade portion 20 is rotated, the gas is drawn from the inlet portion 12 shown on the upper side of FIG. 1A, and transferred toward the thread groove pump mechanism portion 18 while causing gas molecules to collide with the stator blades of the stator blade portion 19 and the rotor blades of the rotor blade portion 20. In the thread groove pump mechanism portion 18, the gas transferred from the turbomolecular pump mechanism portion 17 is introduced to the gap between the rotor cylindrical portion 23 and the thread stator 24 and compressed in the thread groove portion 25. Then, the gas compressed inside the thread groove portion 25 enters the outlet port 26 from the exhaust portion 13 and is then exhausted from the pump main body 11 via the outlet port 26.

The electrical equipment case 31 is described next. As shown in FIG. 1B, a power supply circuit portion 33 as an electrical equipment portion (electrical component portion) and a control circuit portion 34 also as an electrical equipment portion are stored in a rectangular box-shaped box casing 32 of the electrical equipment case 31. The box casing 32 is configured by combining and joining a sheet metal casing panel 35 bent in a C-shape, a cooling jacket 36 as a cooling portion also having an L-shaped cross section, and the like. Note that in FIG. 1A, end closing panels closing both ends of the casing panel 35 (both ends in the direction perpendicular to the page space) are removed so that the inside of the electrical equipment case 31 can be seen. Two rectangular panel members, for example, can be used as the end closing panels.

The cooling jacket 36 includes a jacket main body 37 and a cooling pipe 38. Among them, the jacket main body 37 is a casting having a T-shaped cross section, where the casting integrally includes a first horizontal portion 39*a* and a second horizontal portion 39*b* that are oriented substantially horizontally and a vertical portion 40 oriented substantially vertically. Aluminum or the like can be employed as the material (casting material) of the cooling jacket 36. The first horizontal portion 39*a* has a base end side thereof connected to the vertical portion 40 and facing outside the pump main body 11 and extends a tip end side in the direction toward the main body casing 14. The second horizontal portion 39*h* has a base end side thereof connected to the vertical portion 40 and facing the main body casing 14 and has a tip end side thereof facing outside the pump main body 11.

Figure 2:
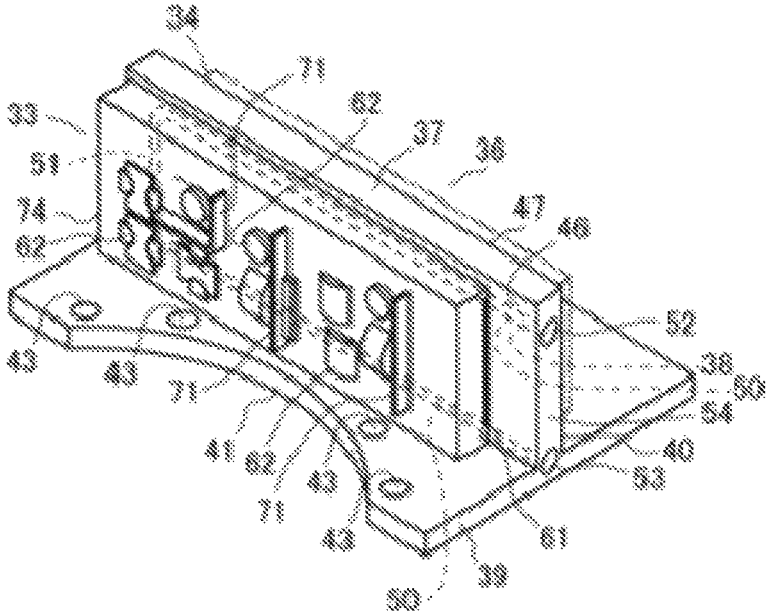
FIG. 2A is a perspective view schematically showing a cooling jacket and a power supply circuit portion.
FIG. 2B is an explanatory diagram showing the positional relationship between a vertical portion and a cooling pipe of the cooling jacket.
Figure 2:
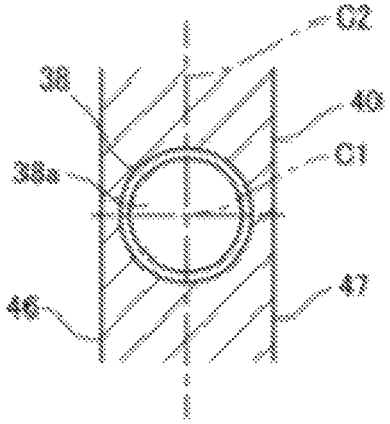

Furthermore, as shown in FIG. 2A, the tip end side of the first horizontal portion 39*a* is cut into an arc shape to match an outer diameter of the pump main body 11, and is provided with a plurality of through holes 43 along the resultant arc-shaped tip end portion 41 to allow the passage of hexagon socket head bolts 42 (only one is shown in FIG. 1A). Also, as shown in FIG. 1A, the tip end side of the horizontal portion 39 is disposed in such a manner as to overlap with a lower surface 44 of the main body casing 14, and is bolted, from below, to a lower flange 45 of the pump main body 11 by the plurality of hexagon socket head bolts 42.

As shown in FIG. 2A, the vertical portion 40 includes an inner surface 46 as a cooling surface facing the pump main body 11, and an outer surface 47 also as a cooling surface facing outside. Furthermore, the vertical portion 40 divides an internal space of the electrical equipment case 31 into a first housing space 31*a* serving as a housing space and a second housing space 31*b* also serving as a housing space. The power supply circuit portion 33 described above is disposed on the inner surface 46 of the vertical portion 40 that faces the first housing space 31*a*. The control circuit portion 34 described above is disposed on the outer surface 47 of the vertical portion 40 that faces the second housing space 31*b*. The power supply circuit portion 33 and the control circuit portion 34 are fixed to the vertical portion 40 by means of bolting or the like in such a manner that the heat can be transferred. The power supply circuit portion 33 and the control circuit portion 34 are described hereinafter.

Here, as shown in FIGS. 1A, 1B, and 2A, the power supply circuit portion 33 is sealed with a mold resin 74 functioning as a mold portion, the mold resin 74 being hatched in FIG. 1A. The mold resin 74 is shown with a two-dot chain line in FIG. 11B and a solid line in FIG. 2A. Specific configurations of the power supply circuit portion 33 and the mold resin 74 are described hereinafter. In FIGS. 1A, 1B, and 2A, although the control circuit portion 34 is surrounded by a two-dot chain line as well, this two-dot chain line does not indicate the mold resin but simply schematically shows the entire region of the control circuit portion 34.

As shown in FIG. 2A, the cooling pipe 38 described above is inserted (insert casting) into the vertical portion 40 of the cooling jacket 36. The cooling pipe 38 is for cooling the inside of the electrical equipment case 31, wherein cooling water (cooling medium, refrigerant) supplied from the outside circulates through a cooling medium flow passage 38*a* provided in the cooling pipe 38. The diameter of the cooling pipe 38 is, for example, approximately several mm, and stainless steel (SUS), copper or the like can be employed as the material of the cooling pipe 38.

The cooling pipe 38 is bent into a C-shape in the vertical portion 40, and includes parallel portions 50 extending substantially horizontally and parallel to each other, and a vertical connecting portion 51 connecting the parallel portions 50. In the present embodiment, of the both ends 52, 53 of the cooling pipe 38, the end 53 on the lower side in FIG. 2A (on the horizontal portion 39 side) serves as an inlet for the cooling water, and the end 52 on the upper side serves as an outlet for the cooling water. However, the flow directions of the cooling water are not limited to the ones described above; the end 52 on the upper side may serve as the inlet, and the end 53 on the lower side may serve as the outlet. In addition, although not shown, a pipe joint can be connected to the ends 5:2, 53 of the cooling pipe 38, to connect the ends 52, 53 to a cooling water circulation path through the joint.

The cooling portion is generally cooled h the cooling water flowing through the cooling pipe 38. However, the cooling medium (refrigerant) is not limited to the cooling water; a fluid other than water or other cooling medium such as a cold gas may be used.

FIG. 2B shows the positional relationship between the cooling pipe 38 and the vertical portion 40. In the diagram, a shaft center C1 of the cooling pipe 38 is positioned on a centerline C2 of the vertical portion 40 in the thickness direction thereof. The entire circumference of the cooling pipe 38 is covered by the vertical portion 40 while in tight contact with the material of the vertical portion 40 (aluminum which is a casting material) by insert casting, without a gap therebetween.

Next, the power supply circuit portion 33 is described on the basis of FIG. 2A. FIG. 2A shows a state obtained after the mold resin 74 is formed. As shown in FIG. 2A, the power supply circuit portion 33 has a circuit board 61, wherein circuit components (electrical components and electronic components) 62 for driving the pump main body 11 are mounted on the circuit board 61. A typical epoxy substrate or the like can be employed as the circuit board 61. The circuit board 61 is fixed to the vertical portion 40 by, for example, bolting four corners of the circuit hoard 61.

Examples of the circuit components 62 include transformers, coils, capacitors, filters, diodes, field effect transistors (FETs), and the like. FIG. 2A shows the circuit components 62 (not shown) in more detail than FIGS. 1A and 1B. These circuit components 62 can be heat generating components, depending on the characteristics thereof. Heat generated by the circuit components 62 moves to the circuit board 61 or surroundings thereof to raise the temperature around the circuit board 61. Part of the heat generated in the circuit board 61 moves toward the cooling jacket 36 via the bolts (not shown) used for joining the circuit hoard 61 to the vertical portion 40 or via the mold resin 74 which is described hereinafter.

Here, when mounting various circuit components 62 onto the circuit board 61, the directions (or "postures") of the circuit components 62 are determined in view of the heights thereof. In other words, although the cooling jacket 36 is positioned on the back side of the circuit board 61 (the non-mounting side) as described above, the circuit components 62 become far away from the cooling jacket 36 as the heights of the circuit components 62 increase on the mounting side of the circuit board 61. Mounting the circuit components 62 having large heights (i.e., tall circuit components 62) upright makes it difficult to transfer heat to the cooling jacket 36 by heat conduction or heat transmission, and as a result the power supply circuit portion 33 cannot be cooled easily.

Therefore, in the present embodiment, the circuit components 62 are laid out on the circuit board 61, at sections where a necessary area can be secured. In such a state in which the circuit components 62 are laid out, the heights thereof from the circuit board 61 can be reduced, and this state can be referred to as "tilted state" or the like. By laying the circuit components 62 so that a larger portion of the circuit components 62 comes close to the cooling jacket 36, the circuit components 62 can be cooled efficiently.

Furthermore, a plurality of sheet metal members 71 made of metal are mounted on the circuit board 61. The sheet metal members 71 can be fixed by providing the circuit board 61 with a member for supporting the sheet metal members 71 or by providing the sheet metal members 71 with ribs for screwing the sheet metal members 71. Aluminum or the like, for example, is used as the material of the sheet metal members 71.

The sheet metal members 71 may be in a flat shape or an L-shape and are fixed to the circuit board 61 so as to stand upright substantially perpendicularly from the circuit hoard 61 (in an upright posture). The sheet metal members 71 have the thickness direction thereof oriented in a direction in which a mounting surface of the circuit board 61 extends (a direction perpendicular to the thickness direction of the circuit board 61). Mounting the sheet metal members 71 in this orientation can minimize the area occupied by the sheet metal members 71 on the mounting surface of the circuit board 61.

In addition, the sheet metal members 71 can be used for mounting the circuit components 62. Of the various circuit components 62, diodes and other semiconductor elements that tend to increase in temperature are fixed to plate surfaces of the sheet metal members 71. Conduction of the semiconductor elements can be ensured by connecting lead portions (not shown) of the semiconductor elements fixed to the sheet metal members 71 to wiring of the circuit board 61. Providing the circuit components 62 on the plate surfaces of the sheet metal members 71 in this manner can increase the area on the circuit board 61 on which the circuit components 62 can be mounted.

Also, the circuit board 61 is sealed with the mold resin 74 as described above. As shown in FIG. 2A, the mold resin 74 is shaped into a rectangular box and is in close contact with the circuit components 62 (including the sheet metal members 71) of the circuit board 61 without a gap therebetween. Furthermore, the mold resin 74 covers a region up to a predetermined height with reference to the mounting surface of the circuit board 61, and only upper ends of relatively tall electronic components protrude from the mold resin 74. In the present embodiment, epoxy resin is used as the mold resin 74, but the material of the mold resin 74 is not limited to epoxy resin; a resin such as silicon can be used.

The mold resin 74 is configured to fulfill the function of improving the insulation with respect to the circuit hoard 6L the drip-proof function, the waterproof function, and the like. The mold resin 74 also functions to cool the power supply circuit portion 33 by coming into contact with the various circuit components and the circuit board 61. Specifically, the mold resin 74 removes the heat from the various circuit components and the circuit board 61 and transfers the removed heat to the rear surface side of the circuit board 61.

The control circuit portion 34 is described next. The control circuit portion 34 is for controlling the motor drive mechanism and magnetic bearings provided in the pump main body 11. As shown in FIGS. 1B and 2A, the control circuit portion 34 is disposed in the second housing space 31*b* formed on the outer surface 47 of the vertical portion 40 in the cooling jacket 36. The control circuit portion 34 is also joined to the outer surface 47 of the cooling jacket 36, so part of the heat generated in the control circuit portion 34 moves toward the cooling jacket 36. In FIG. 2A, the control circuit portion 34 is schematically shown as a rectangular box with a two-dot chain line.

Further, the control circuit portion 34 of the present embodiment has a two-layer laminate structure and includes a metal substrate (aluminum substrate) 86 bolted to the cooling jacket 36, and a resin substrate (glass epoxy substrate or the like) 87 conductively connected to the metal substrate 86. Although not shown, in addition to circuit components 88, connectors and the like in accordance with various standards are mounted on, for example, the resin substrate 87.

In the present embodiment, since the control circuit portion 34 generates less heat compared with the power supply circuit portion 33, resin sealing as in the power supply circuit portion 33 is not performed on the control circuit portion 34. However, if necessary, the control circuit portion 34 may be resin-sealed except for connection terminals of the connectors.

The heat generated by the control circuit portion 34 is transferred not only from the metal substrate 86 joined to the outer surface 47 of the vertical portion 40, but also from a part that is not in direct contact with the vertical portion 40 (such as the resin substrate 87), to the vertical portion 40 via the metal substrate 86 or the space inside of the second housing space 31*b*.

According to the turbomolecular pump 10 of the present embodiment described above, the first housing space 31*a* and the second housing space 31*b* that are divided by the vertical portion 40 of the cooling jacket 36 are formed in the electrical equipment case 31. In the cooling jacket 36, the electrical equipment such as the power supply circuit portion 33 and the control circuit portion 34 are attached to the inner surface 46 and the outer surface 47 of the vertical portion 40, respectively.

Therefore, the electrical equipment (33, 34) can be cooled by recovering the heat of the electrical equipment (33, 34) using the two cooling surfaces (the inner surface 46 and the outer surface 47) facing different directions. Thus, the area that can be cooled by the cooling jacket 36 can be enlarged, thereby cooling more electrical equipment. Therefore, efficient cooling can be achieved without using a cooling fan.

Since a cooling fan is not used, the turbomolecular pump 10 can be downsized. Moreover, not only is it possible to suppress an increase in temperature of the electrical equipment case 31, but also the product life of the turbomolecular pump 10 can be increased. Since efficient cooling can be achieved, the temperature of the cooling water does not need to be lowered much in the preceding stage of the turbomolecular pump 10.

In addition, in the present embodiment, since the electrical equipment (33, 34) are cooled by the inner surface 46 and the outer surface 47 that configure the front and back of the vertical portion 40, cooling of a plurality of surfaces can be realized by simply disposing the cooling pipe 38 in one plane. Also, a wide area can be cooled without laying the cooling pipe 38 in a three-dimensionally complicated shape. Thus, a plurality of cooling surfaces can be formed without complicating the method of bending the cooling pipe 38.

Note that the present invention does not limit the shape of the cooling pipe 38 to the C-shape described in the foregoing embodiment; for example, the cooling pipe 38 can be formed into the shape of an alphabet such as N or M, or into other geometric shapes. Furthermore, the cooling pipe 38 does not have to be formed flat and therefore may be bent three-dimensionally. By forming the cooling pipe 38 into a three-dimensional shape and, for example, by increasing the thickness of the vertical portion 40 or making the vertical portion 40 multifaceted, three or more cooling surfaces can be formed.

According to the turbomolecular pump 10 of the present embodiment, the electrical equipment (33, 34) can be arranged on two surfaces, and, compared to the case where the power supply circuit portion 33 and the control circuit portion 34 are attached integrally to one surface, the length of the vertical portion 40 (the length in the vertical direction in FIG. 1B) can be reduced. Consequently, the cooling jacket 36 and the electrical equipment case 31 can be downsized in the lengthwise direction of the vertical portion 40. Here, "the length of the vertical portion 40" can also be referred to as, for example, the height of the vertical portion 40 or the length of the first horizontal portion 39*a* or the second horizontal portion 39*h* in the thickness direction thereof.

Since the cooling pipe 38 is incorporated in the cooling jacket 36 by means of casting, an outer peripheral surface of the cooling pipe 38 and the jacket main body 37 can be brought into close contact with each other at low cost. Specifically, in a case where, for example, the jacket main body 37 is produced by scraping an aluminum material and then the cooling pipe 38 is fixed to this produced jacket main body 37, a gap is likely to be created between the jacket main body 37 and the cooling pipe 38, increasing the thermal resistance. In order to perform efficient cooling, a sheet or the like made of a material having high thermal conductivity needs to be interposed between the jacket main body 37 and the cooling pipe 38 to fill the gap, which results in a cost increase. However, by incorporating the cooling pipe 38 by means of casting as described in the present embodiment, the outer peripheral surface of the cooling pipe 38 and the jacket main body 37 can be brought into close contact with each other at low cost.

According to the turbomolecular pump 10 of the present embodiment, since the power supply circuit portion 33 is sealed with the mold resin 74, heat transfer through the mold resin 74 can be achieved. In addition, since the rear surface of the circuit board 61 faces the vertical portion 40 of the cooling jacket 36, the heat generated on the mounting surface of the circuit board 61 can be transferred toward the cooling jacket 36 via the mold resin 74.

In the present embodiment, the mold resin 74 is placed between the circuit board 61 and the cooling jacket 36. Therefore, the heat between the circuit board 61 and the cooling jacket 36 can be transferred via the mold resin 74. For this reason, the heat can be transferred easily as compared with the case where space is provided between the circuit board 61 and the cooling jacket 36.

Note that cooling using the mold resin 74 can further enhance the effect of the cooling by the cooling jacket 36. Also, the cooling described in the present embodiment can be a cooling technique that combines the heat transfer by the mold resin 74 and the cooling by means of the cooling jacket 36. In addition, the cooling described in the present embodiment can be a cooling technique that combines air cooling and water cooling, since the space inside the electrical equipment case 31 is cooled as well by the cooling jacket 36.

The present invention can be modified in various ways in addition to the modes described above.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a pump main body; and a control device disposed outside the pump main body, wherein the control device includes a casing, a cooling portion which has a plurality of cooling surfaces and in which a cooling medium flow passage is formed, and a plurality of electrical component portions that have heat generating components and is capable of being cooled by the cooling portion, the cooling portion has a T-shaped cross section, and the plurality of cooling surfaces are formed facing different directions inside of the casing, and the plurality of electrical component portions are attached to the plurality of cooling surfaces respectively so that heat can be transferred and so that at least a portion of the cooling medium flow passage is between the plurality of electrical component portions.

2. The vacuum pump according to claim 1, wherein the plurality of electrical component portions have a circuit board that has the heat generating components mounted thereon and is fixed to the plurality of cooling surface, and at least one of the plurality of electrical component portions is provided with a mold portion that covers the circuit board and the heat generating components at least partially.

3. The vacuum pump according to claim 1, wherein the control device is divided into a plurality of housing spaces by the cooling portion, and each of the housing spaces includes at least one of the plurality of electrical component portions.

4. A control device of a vacuum pump, comprising:

a casing;

a cooling portion which has a plurality of cooling surfaces and in which a cooling medium flow passage is formed, wherein a portion of the cooling portion has a concave shape that matches an exterior shape of a side of the vacuum pump; and a plurality of electrical component portions that have heat generating components and can be cooled by the cooling portion, wherein the cooling portion has a T-shaped cross section, and the plurality of cooling surfaces are formed facing different directions inside of the casing, and the plurality of electrical component portions are attached to the plurality of cooling surfaces respectively so that heat can be transferred and so that at least a portion of the cooling medium flow passage is between the plurality of electrical component portions.

* * * * *